US006626137B2

(12) United States Patent
Hackett

(10) Patent No.: US 6,626,137 B2
(45) Date of Patent: Sep. 30, 2003

(54) AUTOMATIC LASH ADJUSTER

(75) Inventor: David E. Hackett, Washington, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/047,218

(22) Filed: Jan. 14, 2002

(65) Prior Publication Data

US 2003/0131815 A1 Jul. 17, 2003

(51) Int. Cl.[7] ..... F01L 1/18

(52) U.S. Cl. ..... 123/90.45; 123/90.55; 123/90.19

(58) Field of Search ..... 123/90.45–90.46, 123/90.19, 90.55

(56) References Cited

U.S. PATENT DOCUMENTS 3,598,095 A * 8/1971 Ayres ..... 123/90.35
3,882,834 A 5/1975 Goloff et al.
4,227,495 A 10/1980 Krieg
4,655,178 A 4/1987 Meneely
4,898,128 A 2/1990 Meneely
5,201,290 A 4/1993 Hu
5,460,131 A 10/1995 Usko
5,586,533 A 12/1996 Feucht
5,645,031 A 7/1997 Meneely
6,039,018 A * 3/2000 Spath ..... 123/90.55
6,119,644 A * 9/2000 Speil ..... 123/90.55

* cited by examiner

*Primary Examiner*—Thomas Denion
*Assistant Examiner*—Kyle Riddle
(74) *Attorney, Agent, or Firm*—Marshall, Gerstein & Borun

(57) ABSTRACT

A lash adjuster and a method for adjusting lash in an engine valve train are provided. A first component of the lash adjuster is formed from a first material having a first coefficient of thermal expansion. A second component of the lash adjuster is formed from a second material having a second coefficient of thermal expansion greater than the first coefficient of thermal expansion. The second component has an exterior dimension that is greater than or equal to a corresponding interior dimension of the first component when the lash adjuster is heated to an operating temperature.

19 Claims, 4 Drawing Sheets

AUTOMATIC LASH ADJUSTER

TECHNICAL FIELD

The present invention relates generally to lash adjuster mechanisms for internal combustion engines and, more particularly, to hydraulic lash adjusters for internal combustion engines.

BACKGROUND

Lash adjuster mechanisms for valve trains of internal combustion engines are well known in the engine field. Lash adjusters (sometimes referred to as "anti-lash adjusters") serve to compensate for thermal expansion and/or wear of valve train components (such as, for example, valve stems) and maintain a constant gap or lash in engine valve actuation mechanisms, while minimizing delays in valve actuation. When engine components are cold (i.e., when the engine is first started after being shut down for an extended period of time), component dimensions are at a relative minimum. For example, in a valve train, component tolerances normally combine to provide a gap or lash of a distance "X." However, when the engine is warmed up shortly after being started, the engine components expand, and due to this thermal expansion, the gap is reduced, for example, by a distance "TE," resulting in a total gap or lash of X minus TE.

In the absence of such a gap or lash X, when the engine is cold, or in the event that TE is greater than X, once the engine warms up, engine valves will be unintentionally opened slightly due to thermal expansion of valve train components. Such unintentional valve opening can cause adverse engine performance, for example, by preventing engine cylinders or combustion chambers from being sealed during the compression stroke or cycle of engine operation.

Hydraulic lash adjusters employ hydraulic fluid, such as, for example, engine lubricating oil, to vary the length of the lash adjuster to compensate for the expansion of valve train components due to thermal effects. Hydraulic lash adjusters may be located at any convenient location within the valve train, such as, for example, within a cam follower, or alternatively, between a cam follower and a push rod.

Automatic lash adjuster mechanisms or "hydraulic lifters" have been developed that permit the valve train of an internal combustion engine to accommodate thermal expansion and/or wear of valve train components without adverse effects such as unintentional valve opening due to thermal expansion, while at the same time, minimizing, or even eliminating lash and thereby avoiding undesired effects of lash, such as valve opening delays, and valve train component damage and/or wear to valve train components due to impact forces that occur during lash take-up. One example of a hydraulic lash adjuster is disclosed in Krieg, U.S. Pat. No. 4,227,495.

However, conventional hydraulic lash adjuster mechanisms can interfere with the operation of engine compression braking systems. This is because conventional hydraulic lash adjuster mechanisms may respond in an undesirable manner to a gap in the valve train that is created by a brake actuator slightly opening an engine valve. Since the lash adjuster mechanism cannot differentiate between such a gap due to braking and a gap due to valve train component tolerances and/or wear, the lash adjuster mechanism responds by taking up the gap and thereby delaying or preventing the engine valve from closing at a proper time for compression braking. For example, the delay in valve closing may mean that the valve cannot close in time for the next engine braking compression cycle.

The present invention is directed to overcoming one or more of the problems or disadvantages associated with the prior art.

SUMMARY OF THE INVENTION

A lash adjuster mechanism includes a first component formed from a first material having a first coefficient of thermal expansion, and a second component formed from a second material having a second coefficient of thermal expansion greater than the first coefficient of thermal expansion. The second component has an exterior dimension that is greater than or equal to a corresponding interior dimension of the first component when the lash adjuster is heated to an operating temperature.

A method of adjusting lash in a mechanism for opening valves in an internal combustion engine is provided. The method includes the steps of providing a first component formed from a first material having a first coefficient of thermal expansion, providing a second component formed from a second material having a second coefficient of thermal expansion greater than the first coefficient of thermal expansion, and heating the first and second components to a temperature sufficient to induce the first and second components to lock up with respect to one another.

The invention provides a method and apparatus for absorbing component tolerances and wear of the valve train when cold, but locking up when hot. One advantage provided by the invention is the avoidance of the lash adjuster causing interference with an engine braking system.

DETAILED DESCRIPTION

Figure 1:
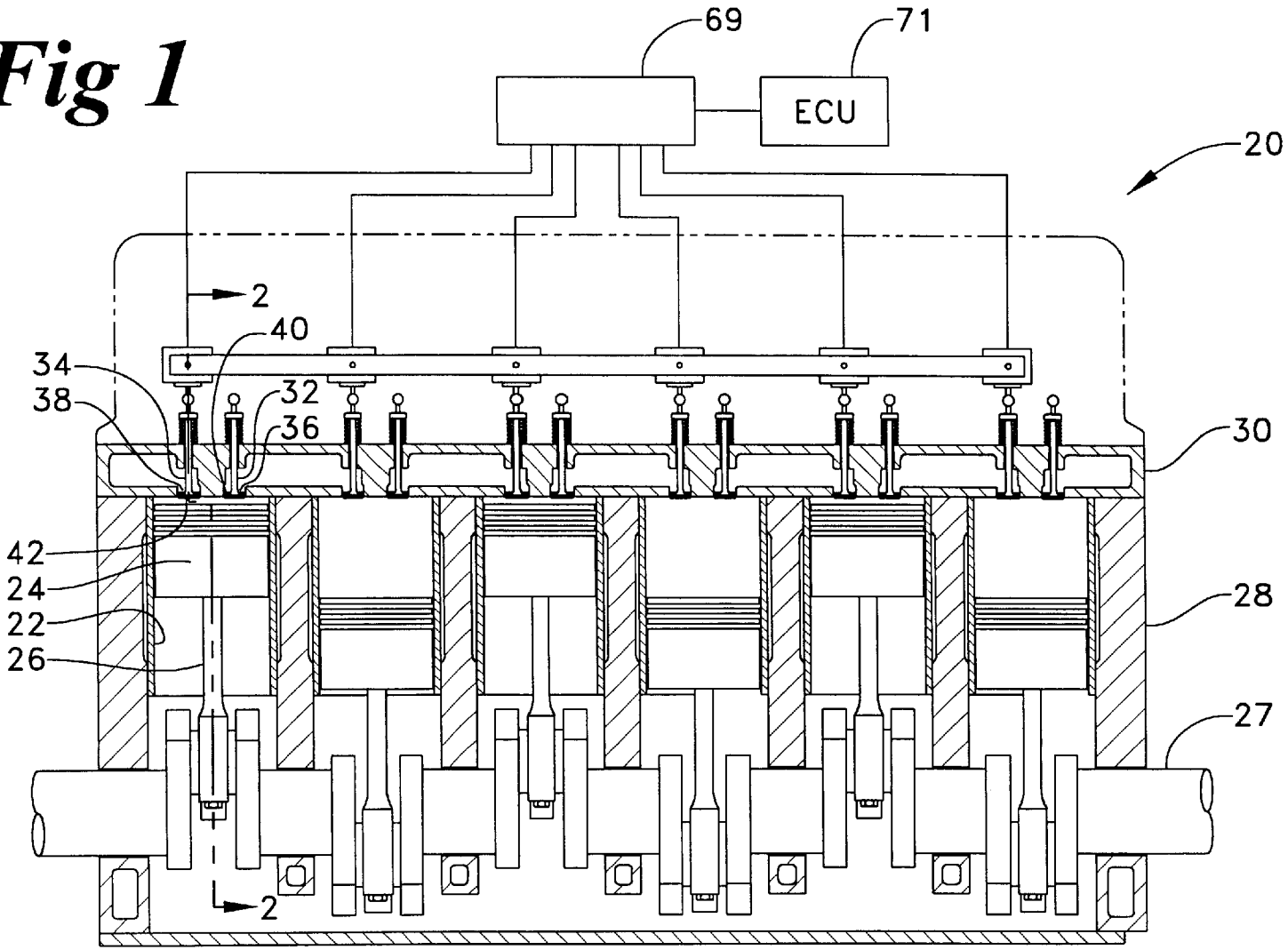
FIG. 1 Is a diagrammatic cross-sectional view of an embodiment of an internal combustion engine, showing an engine block, a cylinder head, and a valve actuation system.

Referring now to the drawings, and with specific reference to FIG. 1, an embodiment of an internal combustion engine is generally referred to by reference numeral 20. While the engine 20 is depicted and will be described in further detail herein with reference to a four stroke, internal combustion engine, it is to be understood that the teachings of the invention can be employed in conjunction with any other type of engine that includes movable valves, such as, for example exhaust valves and intake valves.

The engine 20 may include a plurality of engine cylinders 22 in each of which is reciprocatingly mounted an engine piston 24. In the depicted embodiment, six such engine cylinders 22 and six engine pistons 24 are depicted in aligned fashion, but it is to be understood that a greater or lesser number are possible, and that engine cylinder orientations other than linear are possible as well. A connecting rod 26 may be connected to each engine piston 24, and in turn be connected to a crank shaft 27 so as to capitalize on the motion of the engine piston 24 to produce useful work in a machine (not shown) with which the engine 20 is associated. Each engine cylinder 24 may be provided within an engine block 28 having a cylinder head 30, and further includes at least one intake valve 32, and at least one exhaust valve 34.

Figure 2:
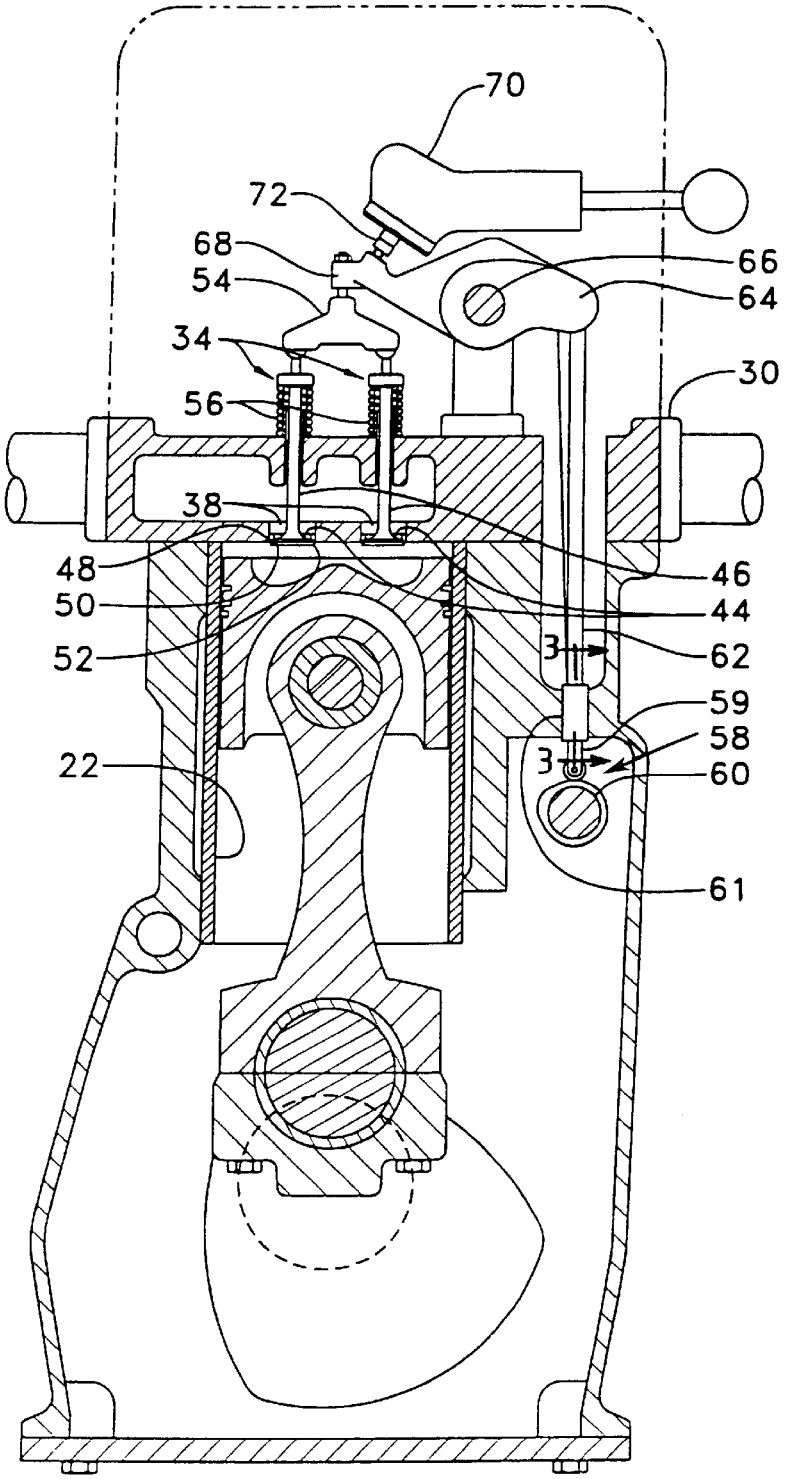
FIG. 2 is a cross-sectional view of the engine of FIG. 1, taken along line 2—2 of FIG. 1.

Referring now to FIG. 2, the cylinder head 30, and a pair of exhaust valves 34 are shown in greater detail for one of the engine cylinders 22. As shown therein, an intake port 36 (FIG. 1) corresponding to each intake valve 32, and an exhaust port 38 corresponding to each exhaust valve 34, may be provided in the cylinder head 30 to allow for fluid communication into and out of the engine cylinder 22. More specifically, in normal engine operation, intake air may be allowed to enter the engine cylinder 22 through the intake port 36, while combustion or exhaust gases may be allowed to exit the engine cylinder 22 through the exhaust port 38. An intake valve element 40 may be provided within each intake port 36, while an exhaust valve element 42 may be provided within each exhaust port 38.

Each of the valve elements 40, 42 may include a valve head portion 44 from which a valve stem 46 extends. The valve head portion 44 includes a sealing surface 48 adapted to seal against a valve seat 50 about a perimeter 52 of the valve ports 36, 38. The valve elements 40, 42 further include a bridge 54 adapted to contact the valve stems 46 associated with each engine cylinder 22. A valve spring 56 imparts force between the top of each valve stem 46 and the cylinder head 30, thereby biasing the stem 46 away from the cylinder head 30 and thus biasing the valve head portions 44 into seating engagement with the corresponding valve seats 50 to close the intake and exhaust valves 32, 34.

As shown best in FIG. 2, movement of the valve elements 42 is controlled not only by the springs 56, but by a cam assembly 58 as well. The cam assembly 58 includes a cam 60 that engages a cam follower 59. The cam follower 59 may be either a slipper follower or a roll follower, and may incorporate a lash adjuster 61. The cam follower 59 is disposed below a push rod 62, that is in turn disposed below a rocker arm 64. The rocker arm 64 is pivotally mounted to a pivot shaft 66, and includes an end portion 68 that is disposed above the valve element 42.

For compression braking operation of the engine 20, a valve actuator 70 may be provided in the vicinity of each of the rocker arms 64. Each valve actuator 70 may be attached to a brake lash adjuster 72, that in turn contacts an upper surface of the rocker arm 64 disposed below the valve actuator 70, as shown in FIG. 2. Each brake lash adjuster 72 may be simply a threaded member to provide adjustability, and may be secured in place with a lock nut (not shown).

Figure 3:
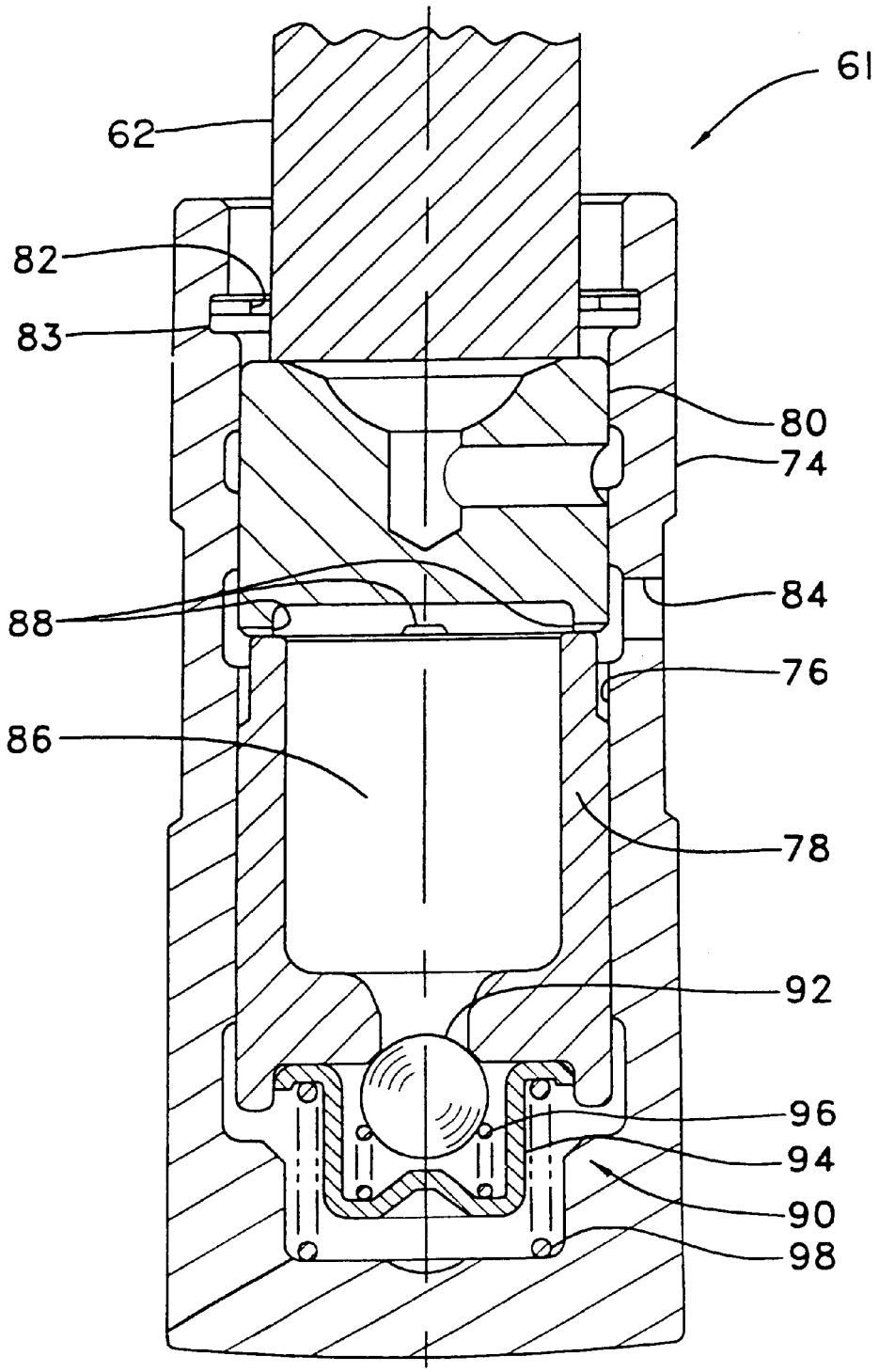
FIG. 3 is a cross-sectional view of a lash adjuster component of the engine of FIG. 1 in a retracted position, taken along line 3—3 of FIG. 2.
Figure 4:
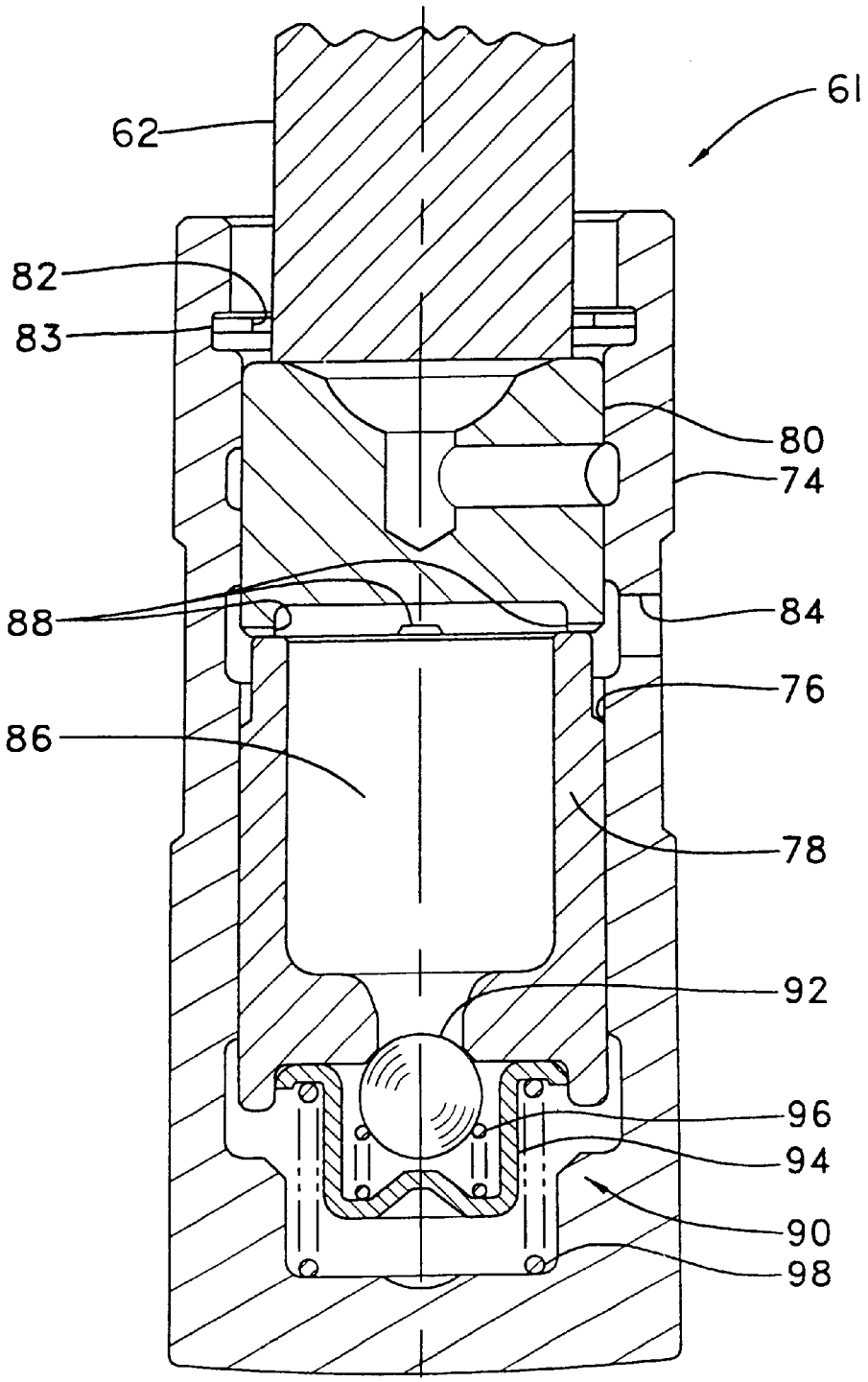
FIG. 4 is a cross-sectional view of the lash adjuster component of FIG. 3, in an extended position.

With reference to FIGS. 3 and 4, each lash adjuster 61 has a first component in the form of a barrel portion 74. The barrel portion 74 includes an axial bore 76. The lash adjuster 61 also includes a second component in the form of a hollow plunger 78. The hollow plunger 78 is telescopically received within the axial bore 76. A plug member 80 is also telescopically received within the axial bore 76. The plug member 80 contacts the push rod 62. A snap ring 82 disposed in an annular groove 83 in the barrel portion 74 limits the travel of the plug member 80 and the hollow plunger 78 with respect to the barrel portion 74. Pressurized oil, such as, for example, from an engine lubrication system (not shown) is fed into the axial bore 76 through an oil supply hole 84 in the side of the barrel portion 74. Oil may enter a reservoir cavity 86 in the interior of the hollow plunger 78 through slots 88 in the plug member 80.

The reservoir cavity 86 is in fluid communication with a check valve assembly, generally indicated at 90. The check valve assembly 90 includes a check valve ball 92, contained within a check ball cage 94. The check valve ball 92 is biased toward the reservoir cavity 86 by a check valve spring 96.

The barrel portion 74 may be formed using a material having a first coefficient of thermal expansion. The plunger 78 and/or the plug member 80 may be formed using a material having a second coefficient of thermal expansion that is greater than the first coefficient of thermal expansion. For example, the barrel portion 74 may be formed from martensitic steel, and the plunger 78 and the plug member 80 may be formed from austenitic steel. Alternatively, the barrel portion 74 and the plug member 80 may both be formed from martensitic steel, and the plunger 78 may be formed from austenitic steel. Other combinations of any suitable materials having the desired combination of thermal expansion coefficients could of course be used. As a result, the plunger 78 and/or the plug member 80 each may have an exterior diameter that is greater than or equal to a corresponding interior diameter of the barrel portion 74 when the brake lash adjuster is heated to an operating temperature of the engine.

Industrial Applicability

As one of ordinary skill in the art will readily recognize, rotation of the cam 60 periodically causes the push rod 62 to rise, thereby causing the rocker arm 64 to pivot about the pivot shaft 66. In so doing, the end portion 68 of the rocker arm 64 is caused to move downwardly and thereby open the exhaust valve element 42. Under normal engine operation, the cam 60 imparts sufficient force to the valve stem 46 to overcome the biasing force of the spring 56 and thereby push the valve head portion 44 away from the valve seat 50, to open the exhaust valves 34. Further rotation of the cam 60 allows the spring 56 to push the end portion 68 of the rocker arm 64 upward and the push rod 62 downward until the cam 60 completes another revolution.

In certain modes of engine operation, such as compression release braking, it is desirable for the exhaust valves 34 to be held open for longer periods, or at a timing sequence other than that dictated by the cam 60. In such situations, the valve actuators 70 may be used to so hold each exhaust valve 34 open. Each valve actuator 70 may be electronically controlled by an engine brake controller 69 that is connected to an engine control unit (ECU) 71, as shown in FIG. 1.

With reference again to FIGS. 3 and 4, the check ball cage 94 is biased toward the hollow plunger 78, and the hollow plunger 78 is biased upwardly against the barrel portion 74, by a plunger spring 98, which abuts the check ball cage 94 and the lower end of the axial bore 76, as oriented in FIG. 3. The check valve spring 96 provides a substantially smaller force as compared to that provided by the plunger spring 98. Accordingly, the check ball cage 94 is essentially fixed against the hollow plunger 78 by the plunger spring 98.

When the engine 20 is operating at a relatively low initial temperature, the lash adjusters 72 will operate in a conventional fashion. Oil may pass into the reservoir cavity 86 through the supply hole 84, through the slots in the plug member 80, and then into the check valve assembly 90, thereby urging the barrel portion 74 downward with respect to the plug member 80 and the plunger 78. This causes the barrel portion 74 to take up lash and assume an extended position, as seen in FIG. 4. As the engine 20 warms up, the plunger 78 and/or the plug member 80 expand at a rate higher than the rate at which the barrel portion 74 expands. Thus, at an elevated steady state temperature, e.g., above about 60° C., the barrel portion 74 is locked in the extended position.

Specifically, the plunger 78 and the plug member 80 are movable with respect to the barrel portion 74 when the engine 20 is at an initial engine temperature (i.e., when the engine is cold, and the barrel portion 74, the plug member 80, and the plunger 78 are at a temperature below about 60° C.). At the initial engine temperature, the barrel portion 74 and the plunger 78 are mated to one another with a sliding fit, and the barrel portion 74 and the plunger member 80 are also mated to one another with a sliding fit. However, the plunger 78 and/or the plug member 80 are not movable, and lock up, with respect to the barrel portion 74 when the engine 20 is at a steady-state temperature that is substantially elevated as compared to the initial temperature (i.e., when the engine is warmed up, and the barrel portion 74, the plug member 80, and the plunger are at a temperature above about 60° C.). This is because, at the elevated steady-state temperature, the barrel portion 74 and the plunger 78 are mated to one another by an interference fit, and/or the plug member 80 and the barrel portion 74 are mated to one another by an interference fit, since the material from which the plunger 78 and/or the plug member 80 are formed has a higher thermal expansion coefficient than the material from which the barrel portion 74 is formed. Thus, once the engine 20 has reached a steady-state operating temperature, the plunger 78, the plug member 80, and the barrel portion 74 are effectively a structurally solid unit, and do not move with respect to one another.

Numerous modifications and alternative embodiments of the invention will be apparent to those skilled in the art in view of the foregoing description. For example, the lash adjuster may be constructed using materials other than, or in addition to, steel. In addition, while the lash adjuster 61 has been shown and described as having a substantially cylindrical configuration, the lash adjuster 61 may certainly have other configurations without departing from the scope of the invention. For example, a lash adjuster having flat but parallel components or components having a substantially rectangular shape, rather than cylindrical components, could nonetheless incorporate the invention. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

Other aspects and features of the present invention can be obtained from a study of the drawings, the disclosure, and the appended claims.

What is claimed is:

1. A lash adjuster comprising:

a first component including a bore and formed from a first material having a first coefficient of thermal expansion;

a second component disposed within the bore and formed from a second material having a second coefficient of thermal expansion greater than said first coefficient of thermal expansion;

said second component sized to allow sliding movement of the second component within the bore of said first component when the lash adjuster is exposed to a first temperature range, said second component having an exterior dimension that is greater than or equal to a corresponding interior dimension of said first component when said lash adjuster is heated to an operating temperature above the first temperature range, thereby fixing the relative position of the second component within the bore when the lash adjuster reaches the operating temperature.

2. The lash adjuster of claim 1, wherein said first material is martensitic steel.

3. The lash adjuster of claim 1, wherein said second material is austenitic steel.

4. The lash adjuster of claim 1, wherein said first temperature range is substantially below about 60° C., and the operating temperature is substantially above about 60° C.

5. The lash adjuster of claim 1, wherein said first and second components are maintained in direct sliding contact when in the first temperature range, and said first and second components are mated to one another with an interference fit when in the operating temperature.

6. An internal combustion engine adapted to operate at an initial temperature and at a steady-state temperature substantially higher than said initial temperature, said internal combustion engine comprising:

a lash adjuster for providing a gap within a valve actuation mechanism when said internal combustion engine is operating at said initial temperature;

said lash adjuster including a first component having a bore and formed from a first material having a first coefficient of thermal expansion, and a second component telescopically received in the bore and formed from a second material having a second coefficient of thermal expansion greater than said first coefficient of thermal expansion;

and wherein said first and second components are adapted to move relative to one another when said internal combustion engine is operating at said initial temperature, and said first and second components are adapted to lock up with respect to one another when said internal combustion engine is operating at said steady-state temperature.

7. The internal combustion engine of claim 6, wherein said first material is martensitic steel.

8. The internal combustion engine of claim 6, wherein said second material is austenitic steel.

9. The internal combustion engine of claim 6, wherein said second component is at least partially surrounded by a portion of said first component.

10. The internal combustion engine of claim 6, wherein said lash adjuster is disposed within the valve train of said engine.

11. The internal combustion engine of claim 10, wherein said lash adjuster is incorporated into a cam follower.

12. A method of adjusting lash in a mechanism for opening valves in an internal combustion engine, the method comprising the steps of:

providing a first component having a bore and formed from a first material having a first coefficient of thermal expansion;

providing a second component sized to be telescopically received in the bore and formed from a second material having a second coefficient of thermal expansion greater than said first coefficient of thermal expansion and at least partially surrounded by a portion of said first component and in contact with said first component; and heating said first and second components to a temperature sufficient to induce said first and second components to lock up with respect to one another.

13. The method of claim 12, wherein said heating step includes a step of warming up said internal combustion engine from an initial temperature to a steady-state temperature substantially higher than said initial temperature.

14. A lash adjuster for use with a push rod in an engine release braking system and comprising:

a barrel having an internal bore and an oil supply hole in communication with the internal bore, the barrel formed from a first material having a first coefficient of thermal expansion;

a plunger disposed within the bore and defining a reservoir cavity;

a plug disposed within the bore, a first portion of the plug arranged to engage the push rod, a second portion if the plug arranged to abut the plunger, the second portion of the plug further arranged to provide a flow path between the supply hole and the reservoir cavity;

at least one of the plunger and the plug formed from a second material having a second coefficient of thermal expansion greater than the first coefficient of thermal expansion, the first and second materials chosen so that the plug and the plunger are slidably disposed within the barrel when the lash adjuster is exposed to a first temperature range, and further wherein the at least one of the plug and the plunger is fixed relative to the barrel when the lash adjuster is exposed to a second temperature range greater than the first temperature range.

15. The lash adjuster of claim 14, wherein the plug and the plunger are maintained within the bore by a snap ring.

16. The lash adjuster of claim 14, wherein the plug includes a plurality of slots arranged to provide flow communication to the reservoir cavity.

17. The lash adjuster of claim 14, wherein both of the plug and the plunger are formed from the second material.

18. The lash adjuster of claim 14, wherein the plunger and plug are shiftable relative to the barrel between an extended position when the lash adjuster is exposed to the first temperature range and a retracted position when the lash adjuster is exposed to the second temperature range.

19. A variable length lash adjuster for use with a push rod and comprising:

a barrel having an internal bore and an oil supply hole in communication with the internal bore, the barrel formed from a first material having a first coefficient of thermal expansion;

a plunger disposed within the bore and defining a reservoir cavity in flow communication with the oil supply hole, the plunger adapted to be responsive to movement of the push rod, the plunger formed from a second material having a second coefficient of thermal expansion greater than the first coefficient of thermal expansion;

the first and second materials chosen so that the plunger is disposed in sliding contact with the bore of the barrel when the lash adjuster is exposed to a first temperature range thereby giving the lash adjuster a variable effective length, and further wherein the plunger is mated to the bore of the barrel with an interference fit when the lash adjuster is exposed to a second temperature range greater than the first temperature range thereby giving the lash adjuster a fixed effective length.

* * * * *